US009066841B2

(12) United States Patent
Mastropole

(10) Patent No.: US 9,066,841 B2
(45) Date of Patent: Jun. 30, 2015

(54) GAS SPRING LIFT ASSISTED TOILET SEAT ASSEMBLY

(71) Applicant: Anthony Michael Mastropole, Bluffton, SC (US)

(72) Inventor: Anthony Michael Mastropole, Bluffton, SC (US)

( * ) Notice: Subject to any disclaimer, the term of this patent is extended or adjusted under 35 U.S.C. 154(b) by 156 days.

(21) Appl. No.: 13/694,177

(22) Filed: Nov. 2, 2012

(65) Prior Publication Data

US 2014/0123382 A1 May 8, 2014

(51) Int. Cl.

| | |
|---|---|
| ***A47K 13/10*** | (2006.01) |
| ***A47K 13/00*** | (2006.01) |
| ***A61G 7/10*** | (2006.01) |
| ***A61G 5/14*** | (2006.01) |

(52) U.S. Cl.

CPC ..... *A61G 7/1007* (2013.01); *A61G 5/14* (2013.01); *A61G 2200/34* (2013.01); *A61G 2200/36* (2013.01)

(58) Field of Classification Search

CPC ..... A47K 13/10
USPC ..... 4/667, 237
See application file for complete search history.

(56) References Cited

U.S. PATENT DOCUMENTS

| | | | | |
|---|---|---|---|---|
| 6,035,462 | A | 3/2000 | Bennett et al. | |
| 6,598,246 | B1 * | 7/2003 | Shou | 4/667 |
| 7,051,383 | B1 | 5/2006 | Paz | |
| 2006/0048296 | A1 * | 3/2006 | Sutou et al. | 4/667 |

* cited by examiner

*Primary Examiner* — Huyen Le
*Assistant Examiner* — Christine Skubinna
(74) *Attorney, Agent, or Firm* — Robert C. Brown

(57) ABSTRACT

A gas spring lift assisted toilet seat assembly comprising a generally u-shaped first frame mountable to a toilet bowl at the rear of the toilet bowl through existing bolt holes in the toilet bowl and extending a distance below the top of the toilet bowl; a second frame mountable to a toilet seat at the rear thereof, preferably but not necessarily by attachment to a toilet seat hinge subassembly; at least one gas spring configured in a permanently open position and pivotably attached at a first end to that portion of the first frame extending below the top of the toilet bowl and pivotably attached at a second end to the second frame; and at least one bracket mountable to a forward part of the toilet seat for pivotable engagement of the toilet seat with the forward rim of the toilet bowl.

8 Claims, 8 Drawing Sheets

GAS SPRING LIFT ASSISTED TOILET SEAT ASSEMBLY

TECHNICAL FIELD

The present invention relates to toilet seats; more particularly, to toilet seat assemblies having power means to assist a toilet seat user in moving from a standing position to a sitting position and the reverse; and most particularly, to such a toilet seat assembly having a greatly simplified design wherein such power is provided by at least one constantly-open gas spring.

BACKGROUND OF THE INVENTION

Conventional toilet seat assemblies are well known in the prior art. A typical prior art toilet seat assembly comprises a generally oval toilet seat having a central opening and a matching toilet seat cover or lid. The seat and lid are connected by a compound hinge which is also secured to a toilet via two bolts extending through the hinge and holes in the toilet bowl. The holes are positioned at the rear of the toilet bowl, adjacent a water tank or other bowl-flushing mechanism, such that the lid and seat may be lifted and pivoted from the front of the bowl as may be desired. In two embodiments, the present invention assumes, and also preserves, this general arrangement.

It is further known that many users of toilet seat assemblies can have difficult in sitting from and then regaining a standing position as necessitated by toilet use. Persons having weak, infirm, or osteoarthritic legs and/or hips may be incapable of sitting and then regaining a standing position without external assistance.

It is known in the prior art to provide mechanisms which pivotably elevate a toilet seat mounted on a toilet by raising from the rear of the seat, causing a user to be gently propelled both upward and forward toward a standing position.

A general shortcoming of the prior art mechanisms is that they tend to be mechanically complex and thus expensive to manufacture and to purchase. In many instances, an assisted toilet seat may be needed for only a few weeks, as during recuperation of patients from knee- or hip-replacement surgery, and purchasing an expensive seat lift assembly cannot be justified.

Such prior art mechanisms typically employ electric or hydraulic motors with numerous levers and gears and complex mechanical or electric controls, which mechanisms may be accompanied by springs and may be intended to provide full mechanical lifting of a toilet user.

It is known in the art to incorporate gas springs in such lifting mechanisms.

U.S. Pat. Nos. 6,067,674 and 6,449,783 disclose a mechanism wherein a toilet seat is pivotably and non-removably attached at the front of a lifting mechanism. A pair of gas springs is attached to a toilet-mounted frame disposed on the top of the toilet bowl. The gas springs are mounted at the front of the lifting mechanism and extend generally rearwards of the toilet bowl, exerting a lifting force on the toilet seat at the rear of the toilet seat. In this arrangement, the gas springs have very poor mechanical advantage at the lifting point, particularly at the fully depressed seat position wherein the maximum lifting force is required. Further, because the seat is non-removably attached, cleaning the toilet bowl and the underside of the toilet seat is very difficult. Further, the gas springs are controlled by a user-activated switch.

U.S. Pat. No. 6,035,462 discloses a portable commode with spring-assisted lifting seat mounted on a lightweight self-supporting stand. The seat is hinged to the frame and a pair of pneumatic springs attached to the frame and the seat lift the seat to an elevated position. The springs yield under the body weight of the user to depress the seat to a lowered position. The springs which may be gas springs can be set at different positions on the seat to adjust for users of different body weights. A removable waste receptacle on the frame permits the commode to be used by itself, as at a bedside location, or over a conventional toilet bowl installation. This device is a self-contained commode having a full stand-alone frame and is not readily nor inexpensively adaptable for use with an existing toilet assembly. The full stand-alone frame is expensive to manufacture; and even when adapted to a toilet assembly, the frame rather than the toilet assembly must bear the full weight of the user.

U.S. Pat. No. 7,051,383 discloses a powered lift toilet seat comprising a toilet seat for sitting on, a back support for supporting a back of a person sitting on the toilet seat, and an actuator connected to the toilet seat and back support by a linkage device for raising and tilting the toilet seat and for moving the back support outwards, wherein the actuator is housed together with a toilet tank placed behind the back support, wherein the toilet tank has a recess for receiving therein the back support, and wherein the recess is concave and a rear portion of the back support that is received in the recess is convex. The actuator may include a gas spring. The actuator is housed in an integral toilet tank assembly such that the invention is not readily nor inexpensively adaptable to an existing toilet assembly and requires significant disassembly of an existing toilet.

What is needed in the art is a gas spring lift assisted toilet seat assembly that has few components, is simple to assemble and install, is affixed to a toilet bowl via the original seat bolt holes, and has excellent mechanical advantage for lifting a toilet seat from a seated-user position.

It is a principal object of the present invention to lift a toilet assembly user simply and inexpensively from a sitting position toward a standing position.

SUMMARY OF THE INVENTION

Briefly described, a gas spring lift assisted toilet seat assembly in accordance with the present invention can be installed onto a conventional flush toilet bowl between a conventional toilet seat/lid assembly and the toilet bowl. The assembly comprises a generally u-shaped first frame mountable to a toilet bowl at the rear of the toilet bowl through existing bolt holes in the toilet bowl and extending along both sides of the toilet bowl a distance below the top of the toilet bowl; a second frame mountable to a toilet seat at the rear thereof, preferably but not necessarily by attachment to a toilet seat hinge subassembly; at least one gas spring configured in a permanently open position and pivotably attached at a first end to that portion of the first frame extending below the top of the toilet bowl and pivotably attached at a second end to the second frame; and at least one bracket mountable to a forward part of the toilet seat for pivotable engagement of the toilet seat with the forward rim of the toilet bowl.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently-preferred embodiments of the invention, and such exemplifications are not to be construed as limiting the scope of the invention in any manner.

DESCRIPTION OF THE PREFERRED EMBODIMENTS

Figure 1:
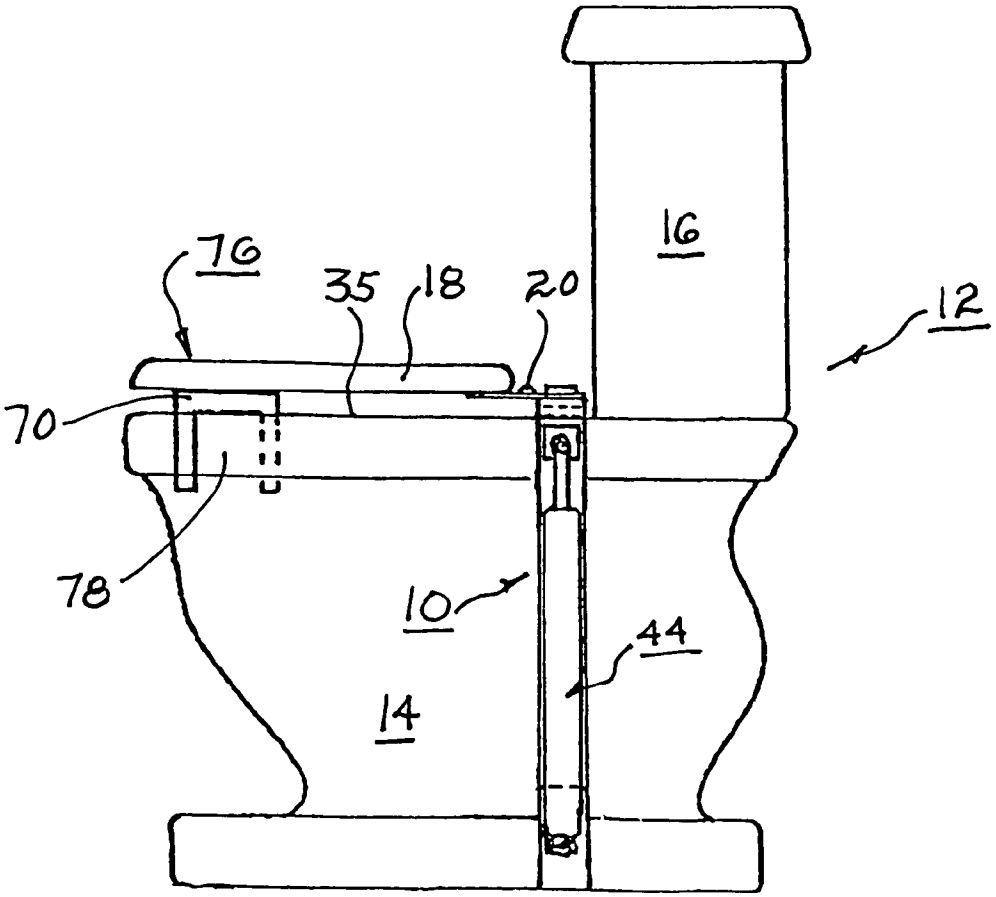
FIG. 1 is an elevational view of a toilet assembly equipped with a first embodiment of a gas spring lift assisted toilet seat assembly in accordance with the present invention, showing the seat assembly in lowered position for a seated user.

Referring to FIGS. 1 through 5, a first embodiment 10 of a gas spring lift assisted toilet seat assembly (FIG. 4) in accordance with the present invention is shown mounted to a conventional flush toilet assembly 12 comprising a toilet bowl 14, water closet or tank 16, toilet seat 18, and toilet seat hinge 20. (Note that in all drawings a conventional toilet seat lid that is typically provided with a toilet seat is omitted for clarity of presentation but is fully consistent with all aspects of the present disclosure and claims.)

First embodiment 10 comprises a generally u-shaped first frame 30 mountable to toilet bowl 14 at the rear of the toilet bowl, preferably through the existing bolt holes (not visible) in the toilet bowl provided by the manufacturer for attaching a conventional toilet seat assembly, as is well known in the prior art. First frame 30 is preferably formed of metal, e.g., as by bending strap stock, and comprises a central portion 32 having holes 34 for attachment to the upper surface of toilet bowl 14 as just described; and first and second side portions 36*a*,36*b* extending a distance below top 35 (along the sides) of toilet bowl 14 and provided with fittings 38*a*,38*b* near the lower ends 40*a*,40*b* thereof for pivotably receiving lower connectors 42*a*,42*b* of first and second conventional gas springs 44*a*,44*b* described more fully below.

First embodiment 10 further comprises a generally u-shaped second frame 50 formed preferably of metal, e.g., as by bending strap stock, and having a central portion 52 mountable to toilet seat 18 at the rear thereof, preferably but not necessarily, by attachment to toilet seat hinge subassembly 20 via bolt holes 54. Second frame 50 further comprises first and second side portions 56*a*,56*b* extending outboard of side portions 36*a*,36*b* of first frame 30 and provided with fittings 58*a*,58*b* near the upper ends 60*a*,60*b* thereof for pivotably receiving upper connectors 62*a*,62*b* of first and second conventional gas springs 44*a*,44*b*.

As will be readily recognized by those of ordinary skill in the mechanical arts, this arrangement when installed on said toilet bowl of first frame 30, second frame 50, lower fittings 38*a*,38*b* directly below upper fittings 58*a*,58*b*, and gas springs 44 provides direct vertical lift of a user sitting on toilet seat 18 at maximal mechanical efficiency (horizontal thrust vectors are zero).

Figure 4:
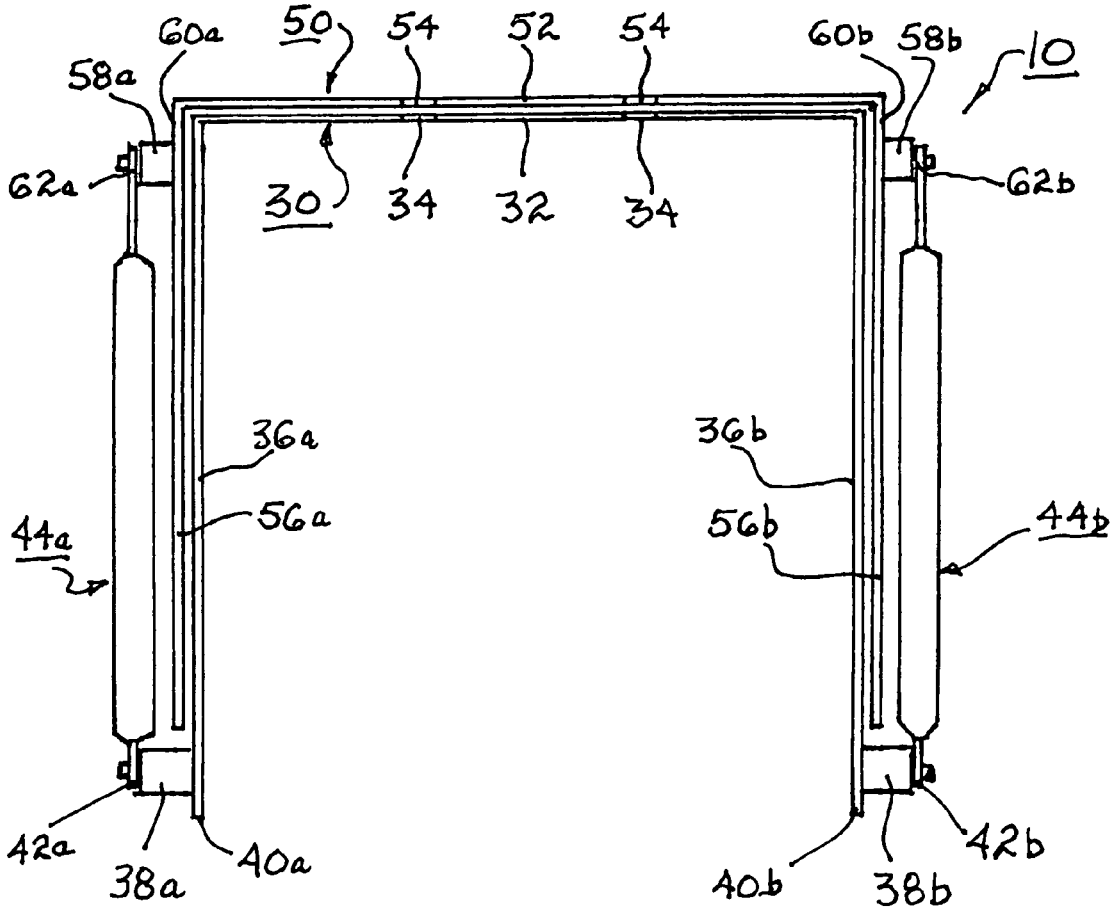
FIG. 4 is an elevational view of the first embodiment of a gas spring lift assisted toilet seat assembly shown in FIG. 1.
Figure 5:
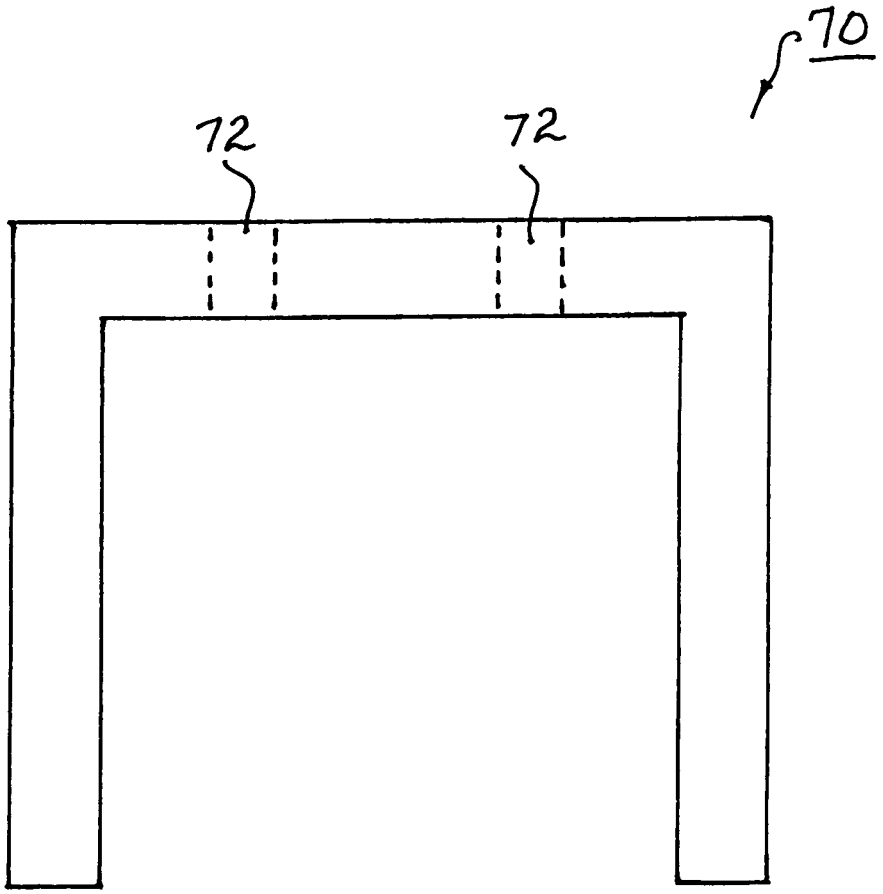
FIG. 5 is an elevational view of a bracket in accordance with the present invention.
Figure 6:
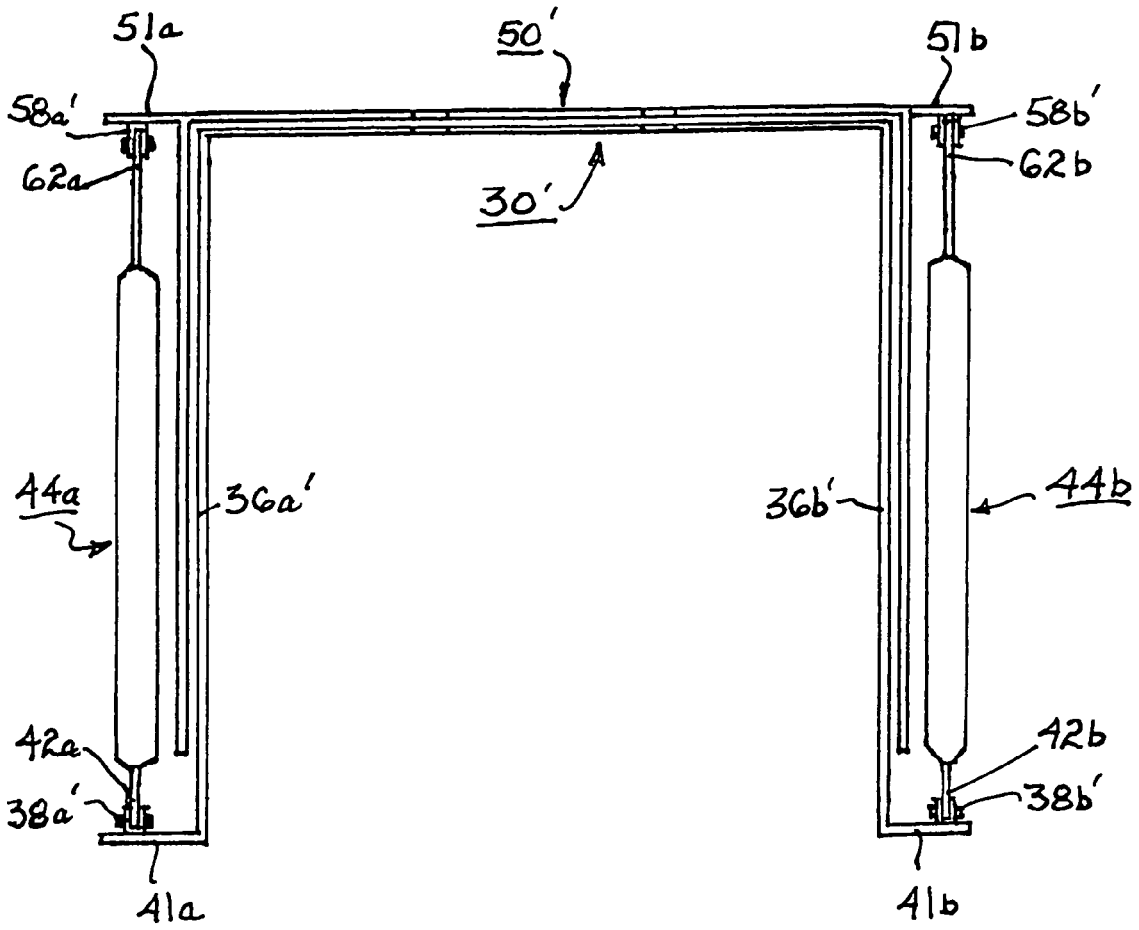
FIG. 6 is an elevational view of a second embodiment of a gas spring lift assisted toilet seat assembly in accordance with the present invention.

First embodiment 10 comprises at least one such gas spring 44, and preferably two, as shown in FIG. 4. Suitable gas springs for the present invention are available from, for example, SUSPA, Inc., Grand Rapids, Mich. USA, and may be selected according to lifting capability to accommodate users of differing weights. Gas springs 44 are configured in a permanently open position.

First embodiment 10 further comprises at least one u-shaped bracket 70 having bores 72 for mounting as by screws (not shown) to a forward part 76 of toilet seat 18 for pivotable engagement of toilet seat 18 with the forward rim 78 of toilet bowl 14. Preferably, two brackets 70 are provided, disposed symmetrically on opposite sides of the centerline (not shown) of toilet seat 78 which may be either complete a oval or horseshoe-shaped.

Referring to FIG. 4, a second embodiment 10' of a gas spring lift assisted toilet seat assembly in accordance with the present invention is similar to first embodiment 10 except that a) first and second side portions 36*a*',36*b*' of first frame 30' terminate in respective ears 41*a*,41*b* and are provided with fittings 38*a*',38*b*' which may be, for example, sockets or clevises; and b) second frame 50' is provided with respective ears 51*a*,51*b* extending beyond first and second side portions 56*a*'56*b*' and are provided with fittings 58*a*'58*b*' which may be, for example, sockets or clevises.

Alternatively, first and second side portions 56*a*'56*b*' may be omitted (not shown), and second frame 50' may be thus provided as a straight bar terminating in ears 51*a*,51*b*.

Figure 2:
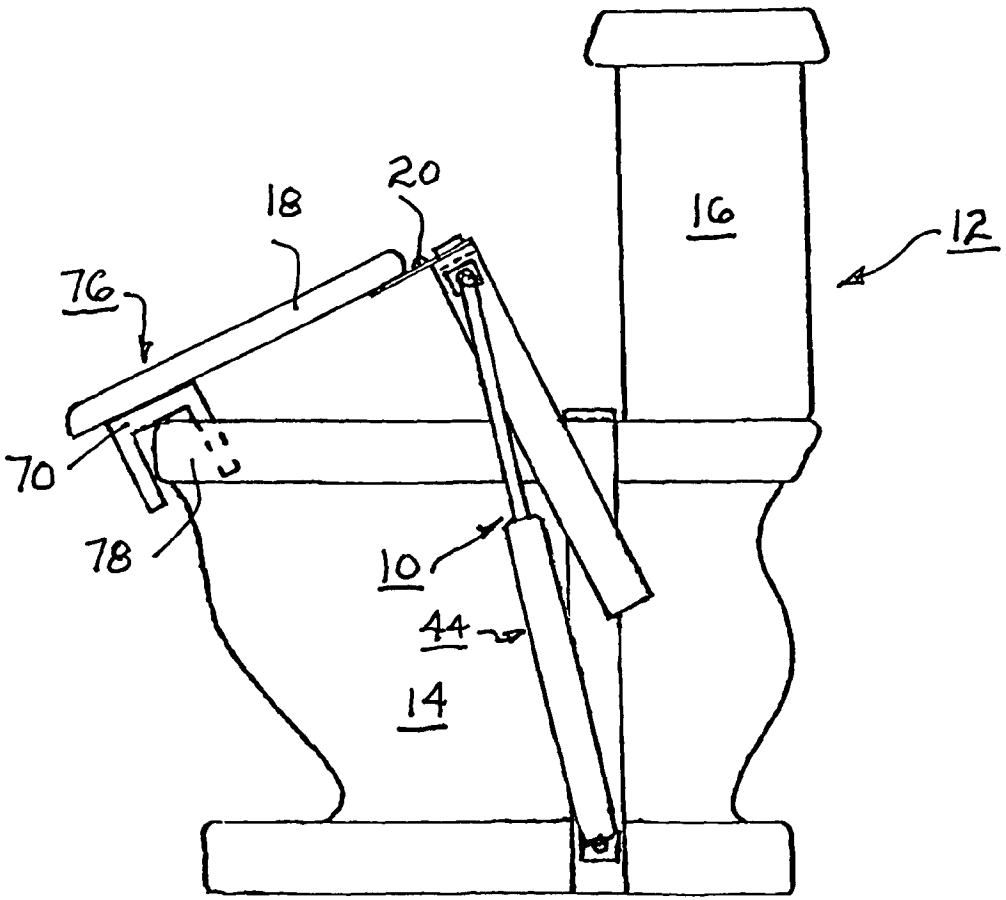
FIG. 2 is an elevational view like that shown in FIG. 1, showing the seat assembly in elevated position for assisting a seated user toward a standing position or helping a user from a standing position to a sitting position.

In operation, first and second embodiments 10 and 10' are identical. In rest position, gas springs 44 are fully extended and seat 18 is inclined, as shown in FIG. 2. A user facing away from toilet assembly 12 places the user's buttocks against toilet seat 12 and gradually sits back against toilet seat 12 thereby applying progressively greater force against toilet seat 12 and, by connection, to gas springs 44*a*,44*b* which respond by slowly being compressed until toilet seat 18 is horizontally engaged with toilet bowl 14 and the user is in a sitting position. The return to standing is the opposite: as the user gradually reduces sitting pressure against toilet seat 12, gas springs 44*a*,44*b* gradually extend, raising the user from a sitting position toward a standing position.

Figure 8:
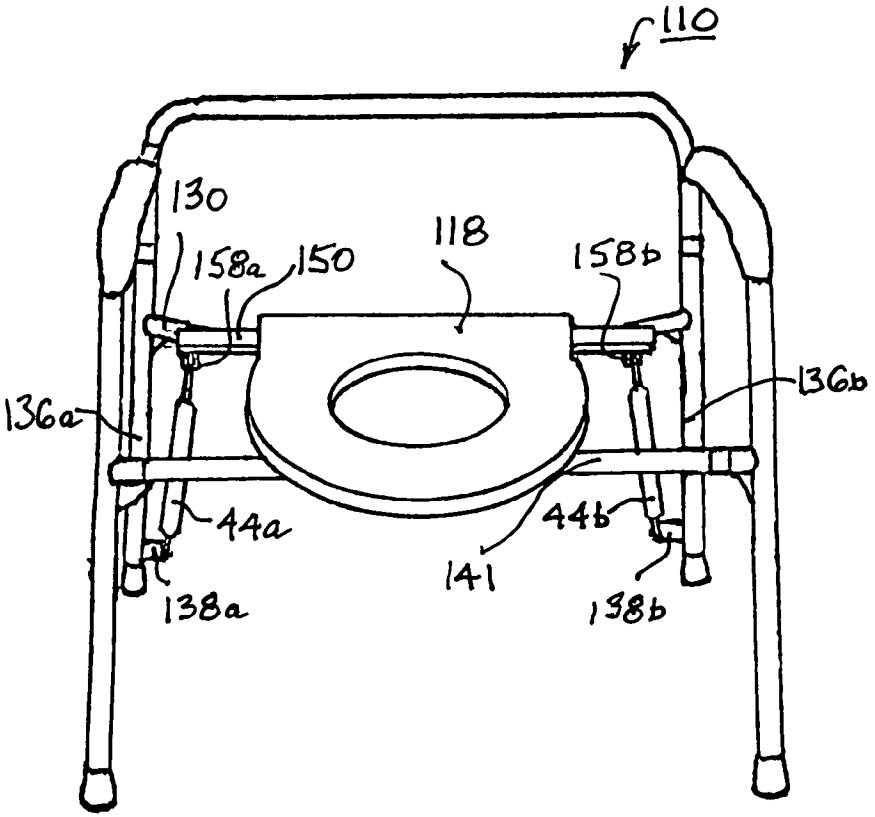
FIG. 8 is a front isometric view of a third embodiment of a gas spring lift assisted toilet seat assembly in accordance with the present invention, showing the assembly in a user-seated position.
Figure 7:
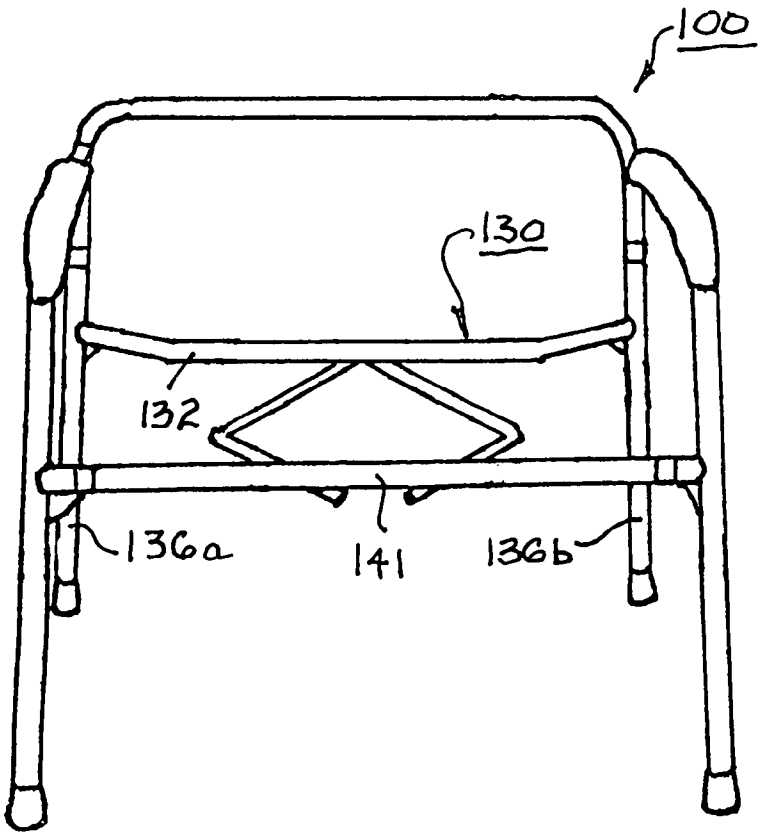
FIG. 7 (PRIOR ART)
FIG. 7 is a front isometric view of a prior art portable commode assembly, shown for clarity without a toilet seat and seat cover and commode pot.
Figure 9:
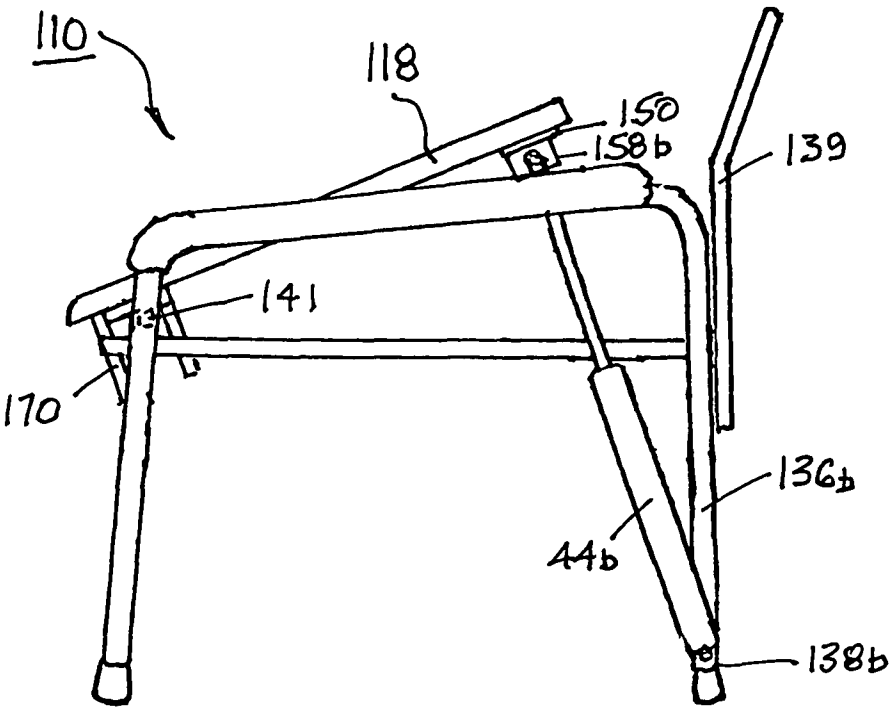
FIG. 9 is a side elevational view of the third embodiment shown in FIG. 8, showing the assembly in a raised-seat position.

Referring to FIGS. 7-9, a third embodiment 110 of a gas spring lift assisted toilet seat assembly in accordance with the present invention is similar to first embodiment 10 except that first and second side portions 136*a*,136*b* and central portion 132 first frame 130 are portions of a frame 100 of a prior art portable commode. Second frame 150 is a straight metal bar provided with fittings 158*a*,158*b* which may be, for example, sockets or clevises. Toilet seat 118 is mounted to second frame 150. At least one bracket 170 is mounted to toilet seat 118 and straddles frame crossbar 141. Second frame 150 when depressed by a user in sitting position rests upon central portion 130. First and second gas springs 44*a*,44*b* are connected at their respective upper ends to fittings 158*a*,158*b* and at their lower ends to fittings 138*a*,138*b* mounted to side portions 136*a*,136*b*. Preferably, gas springs 44*a*,44*b* are connected to the upper and lower fittings via removable pins to permit convenient folding of frame 100 as is known in the prior art.

Figure 3:
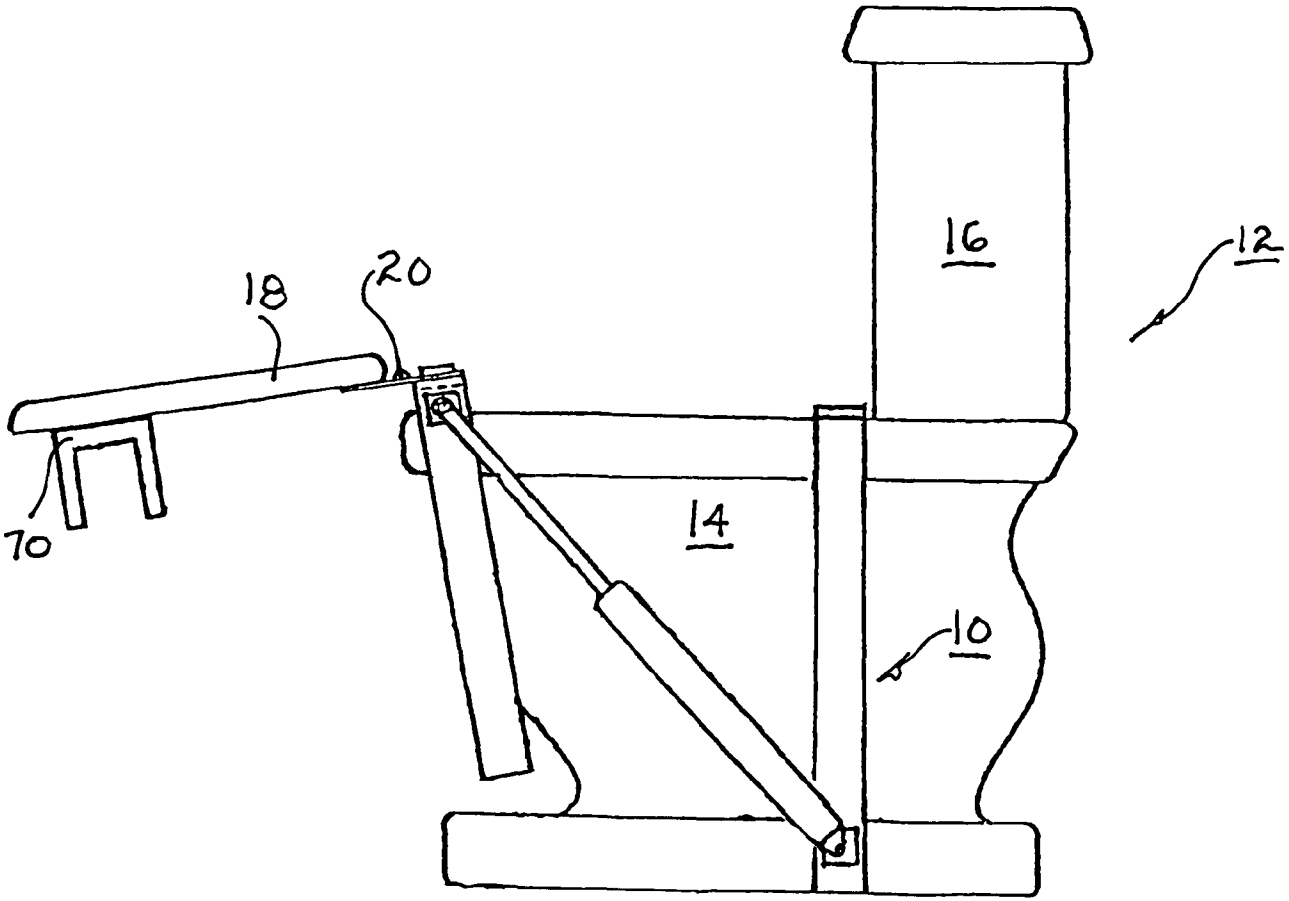
FIG. 3 is an elevational view like that shown in FIG. 1, showing the seat assembly in a forward position for cleaning the toilet bowl.

Frame 100 further comprises a back member 139 that typically is removable, permitting frame 100 minus its accompanying commode bucket (not shown) to be placed over and used with a conventional toilet as shown in FIGS. 1-3. Note further that central portion 130 preferably is bowed forward as shown in FIG. 7 to avoid interference with toilet tank 16 when positioning toilet seat 118 correctly over toilet bowl 14.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A gas spring lift assisted toilet seat assembly, consisting of:

a) a U-shaped first frame attachable to an associated toilet bowl assembly and having first and second side portions extending downward a distance from a toilet seat of said associated toilet bowl assembly to which said assembly may be mounted, wherein said U-shaped first frame in use is attached to and supported by said associated toilet bowl assembly;

b) a U-shaped second frame mountable to said toilet seat at the rear thereof and straddling said U-shaped first frame and having first and second side portions extending downward a distance from said toilet seat outside said first and second side portions of said U-shaped first frame;

c) at least one gas spring pivotably attached at a first end to one of said first and second side portions of said U-shaped first frame and pivotably attached at a second end to one of said first and second side portions of said U-shaped second frame; and d) at least one bracket mountable to a forward part of said toilet seat.

2. An assembly in accordance with claim 1 wherein said U-shaped first frame is attachable to said associated toilet bowl assembly via existing bolt holes in said toilet bowl.

3. An assembly in accordance with claim 1 wherein said hinged toilet seat is attachable to said U-shaped second frame via a toilet seat hinge subassembly therebetween.

4. An assembly in accordance with claim 1 wherein said gas spring is configured in a permanently open position for passage of gas in either direction between a first compressed mode and a second extended mode of said gas spring.

5. An assembly in accordance with claim 1 comprising first and second gas springs disposed on opposite sides of a centerline of said assembly.

6. An assembly in accordance with claim 1 comprising first and second brackets disposed on opposite sides of a centerline of said assembly.

7. An assembly in accordance with claim 1 wherein said assembly when installed on said associated toilet bowl provides direct vertical lift via said at least one gas spring of a user sitting on said hinged toilet seat.

8. An assembly in accordance with claim 1 further comprising a toilet seat lid.

* * * * *